US005121961A

United States Patent [19]

Marshall

[11] Patent Number: 5,121,961

[45] Date of Patent: Jun. 16, 1992

[54] FOLDABLE BODY SUPPORT APPARATUS

[76] Inventor: Michael M. Marshall, 3711 St. Clair, Ave. E., Scarborough Ontario, Canada, M1M 1T5

[21] Appl. No.: 719,638

[22] Filed: Jun. 24, 1991

[51] Int. Cl.[5] ..... A47C 4/00

[52] U.S. Cl. ..... 297/17; 297/188; 297/284 B; 5/419

[58] Field of Search ..... 297/17, 16, 188, 191, 297/192, 377, 284 A, 284 B; 5/417, 419, 420, 432, 433

[56] References Cited

U.S. PATENT DOCUMENTS

| | | | |
|---|---|---|---|
| D. 167,514 | 8/1952 | Hicks | 297/17 X |
| 2,480,196 | 8/1949 | Poyer | 5/419 |
| 3,404,915 | 10/1968 | de Souza Filho | 297/17 |
| 4,190,286 | 2/1980 | Bentley | 297/284 B |
| 4,818,017 | 4/1989 | Dykstra et al. | 297/188 X |
| 5,042,874 | 8/1991 | Williams | 297/377 X |

FOREIGN PATENT DOCUMENTS

| | | | |
|---|---|---|---|
| 1034337 | 12/1954 | Fed. Rep. of Germany | 5/419 |

*Primary Examiner*—Laurie K. Cranmer
*Attorney, Agent, or Firm*—Leon Gilden

[57] ABSTRACT

An apparatus including a torso support housing, with a first and second leg support housing mounted longitudinally and pivotally relative to one another to permit interfolding of the structure during periods of transport and storage. The torso support housing includes a support leg receiving cavity to receive a pivotal support leg therewithin to enhance compactness of the organization in a stored and interfolding configuration. The organization further includes pneumatic chambers mounted coextensively with top surfaces of each support housing and selectively inflatable for enhanced comfort of an individual. A cup support holder and handle are retractably mounted within the torso support housing.

4 Claims, 4 Drawing Sheets

FOOT
BODY
HEAD
11
18
19
24
25
26
27
28
36
37
38
39
40
41
42
43

FOLDABLE BODY SUPPORT APPARATUS

BACKGROUND OF THE INVENTION

1. Field of the Invention

The field of invention relates to foldable seat apparatus, and more particularly pertains to a new and improved foldable body support apparatus wherein the same is arranged for extension during periods of use and interfolding during periods of transport and storage.

2. Description of the Prior Art

Various prior art structure has been utilized to provide seat structure that may be interfolded relative to itself and extended to accommodate an individual thereon. Such structure is exemplified for example in U.S. Pat. No. 4,775,182 to Hoffman setting forth a foldable beach chair wherein a first frame is foldable relative to a second frame member.

U.S. Pat. No. 4,793,012 to Laporte sets forth a beach mat structure wherein a framework accommodates a mat member mounted thereon.

U.S. Pat. No. 4,890,882 to Harrington sets forth a collapsible beach chair wherein a pivoted back frame is foldable relative to a torso supporting frame, wherein the organization is fitted within an associated bag structure.

As such, it may be appreciated that there continues to be a need for a new and improved foldable body support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of foldable chair structure now present in the prior art, the present invention provides a foldable body support apparatus wherein the same is arranged for interfolding for transport and storage during periods of non-use. As such, the general purpose of the present invention, which will be described subsequently in greater detail, is to provide a new and improved foldable body support apparatus which has all the advantages of the prior art foldable chair apparatus and none of the disadvantages.

To attain this, the present invention provides an apparatus including a torso support housing, with a first and second leg support housing mounted longitudinally and pivotally relative to one another to permit interfolding of the structure during periods of transport and storage. The torso support housing includes a support leg receiving cavity to receive a pivotal support leg therewithin to enhance compactness of the organization in a stored and interfolding configuration. The organization further includes pneumatic chambers mounted coextensively with top surfaces of each support housing and selectively inflatable for enhanced comfort of an individual. A cup support holder and handle are retractably mounted within the torso support housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foldable body support apparatus which has all the advantages of the prior art foldable chair apparatus and none of the disadvantages.

It is another object of the present invention to provide a new and improved foldable body support apparatus which may be easily and efficiently manufactured and marketed.

It is a further object of the present invention to provide a new and improved foldable body support apparatus which is of a durable and reliable construction.

An even further object of the present invention is to provide a new and improved foldable body support apparatus which is susceptible of a low cost of manufacture with regard to both materials and labor, and which accordingly is then susceptible of low prices of sale to the consuming public, thereby making such foldable body support apparatus economically available to the buying public.

Still yet another object of the present invention is to provide a new and improved foldable body support apparatus which provides in the apparatuses and methods of the prior art some of the advantages thereof, while simultaneously overcoming some of the disadvantages normally associated therewith.

Still another object of the present invention is to provide a new and improved foldable body support apparatus wherein the same is arranged for mounting pneumatic chambers coextensively with top surfaces of each of a plurality of pivotal support housings to permit selective inflation of each chamber for comfort and convenience of a user thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
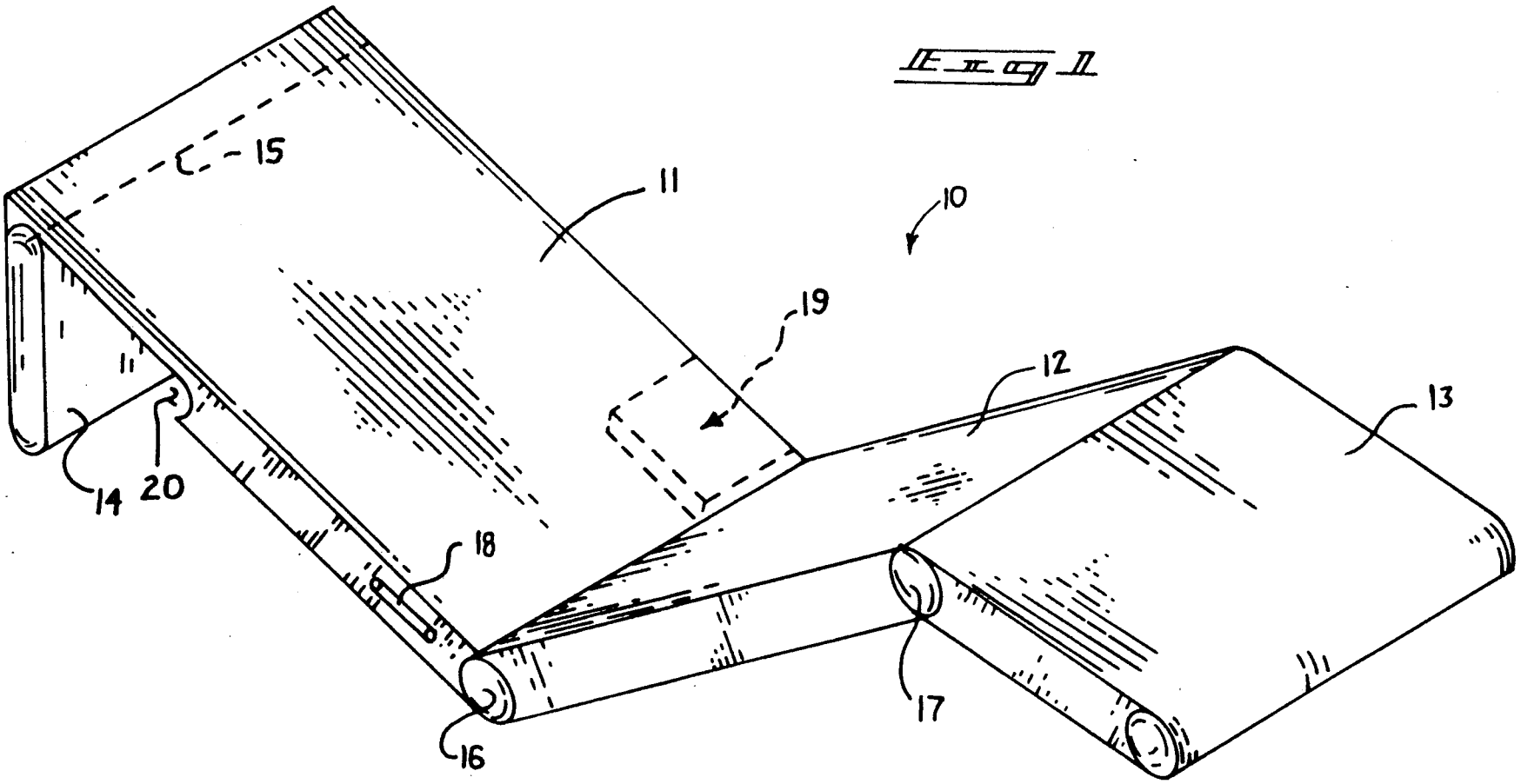
FIG. 1 is an isometric illustration of the instant invention.

With reference now to the drawings, and in particular to FIGS. 1 to 10 thereof, a new and improved foldable body support apparatus embodying the principles and concepts of the present invention and generally designated by the reference numerals 10 and 10*a* will be described.

Figures 2, 3, 4:
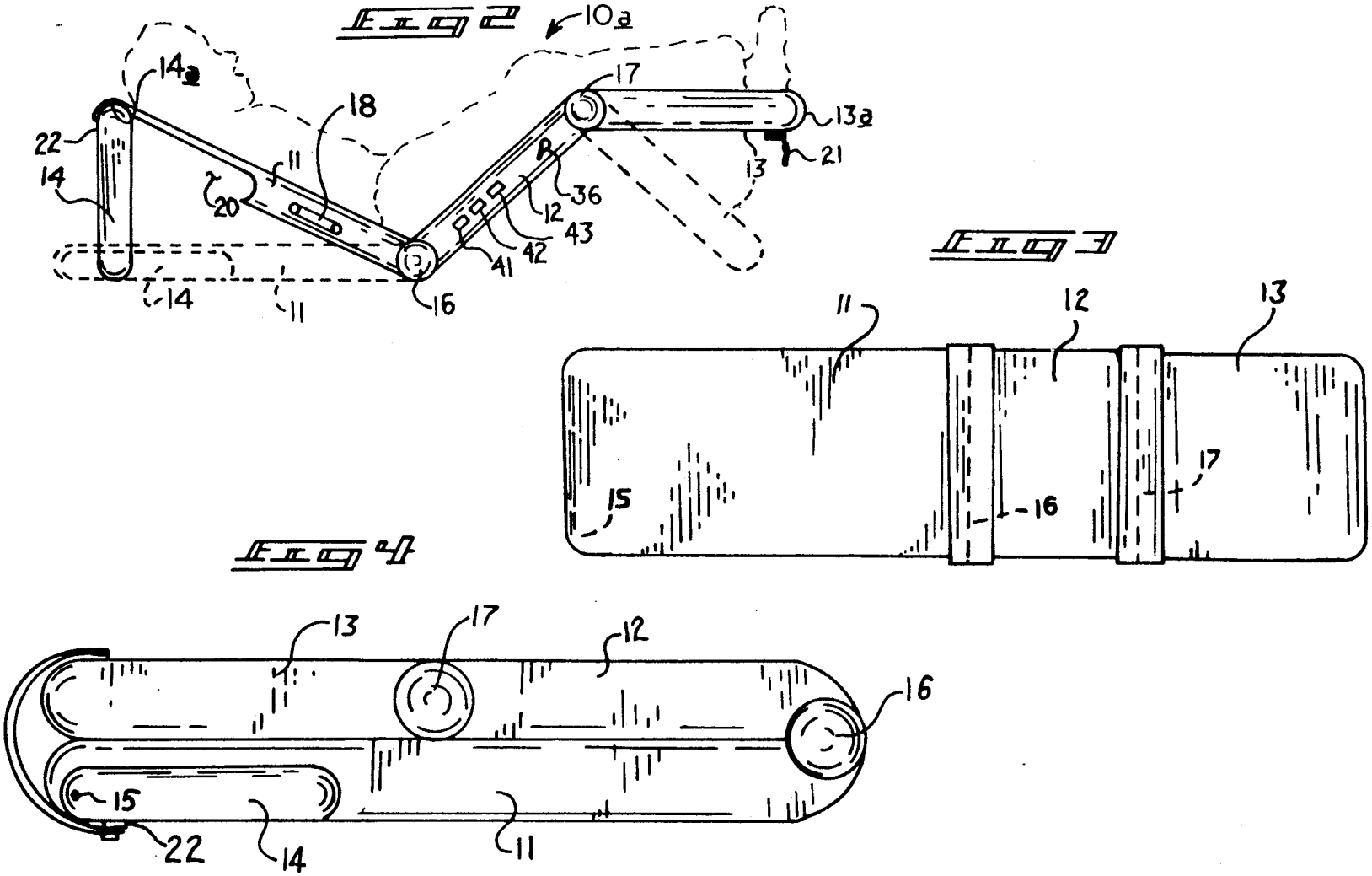
FIG. 2 is an orthographic side view of the instant invention.
FIG. 3 is an orthographic top view of the invention.
FIG. 4 is an orthographic side of the invention in a folded configuration.

More specifically, the foldable body support apparatus 10 of the instant invention essentially comprises a torso support housing 11 defining a planar top surface and a planar bottom surface, with a first leg support housing 12 pivotally mounted to the torso support housing about a second pivot axle 16. A second leg support housing 13 is pivotally mounted to the first leg support housing 12 about a third pivot axle 17. A support leg 14 defined by a predetermined configuration is pivotally mounted adjacent a rear terminal end of the torso support housing 11 spaced from the first leg support housing 12 about the first axle 15. Each of the support housings are defined by a planar top and bottom surface to permit interfolding of the configuration, in a manner as illustrated in FIG. 4 for example. A support leg receiving cavity 20 defined by a configuration equal to the predetermined configuration is formed in the bottom surface of the torso support housing 11 to complementarily receive the support leg 14 therewithin, as illustrated. A retractable handle 18 is directed through a first side of the torso support housing 11, with a drink support assembly 19 retractably mounted within a second side of the torso support housing 11 opposed to that of the handle 18. A hook and loop strap member 21 is mounted medially adjacent a forward terminal end 13*a* of the second leg support housing 13, and is securable to a hook and loop fastener patch 22 that is mounted medially adjacent an inner end 14*a* of the support leg 14 adjacent the intersection of the support leg 14 with the torso support housing 11. The strap member 21 is securable to the fastener patch 22 to secure the assembly in an interfolded configuration, as illustrated in FIG. 4.

Figures 5, 6, 7:
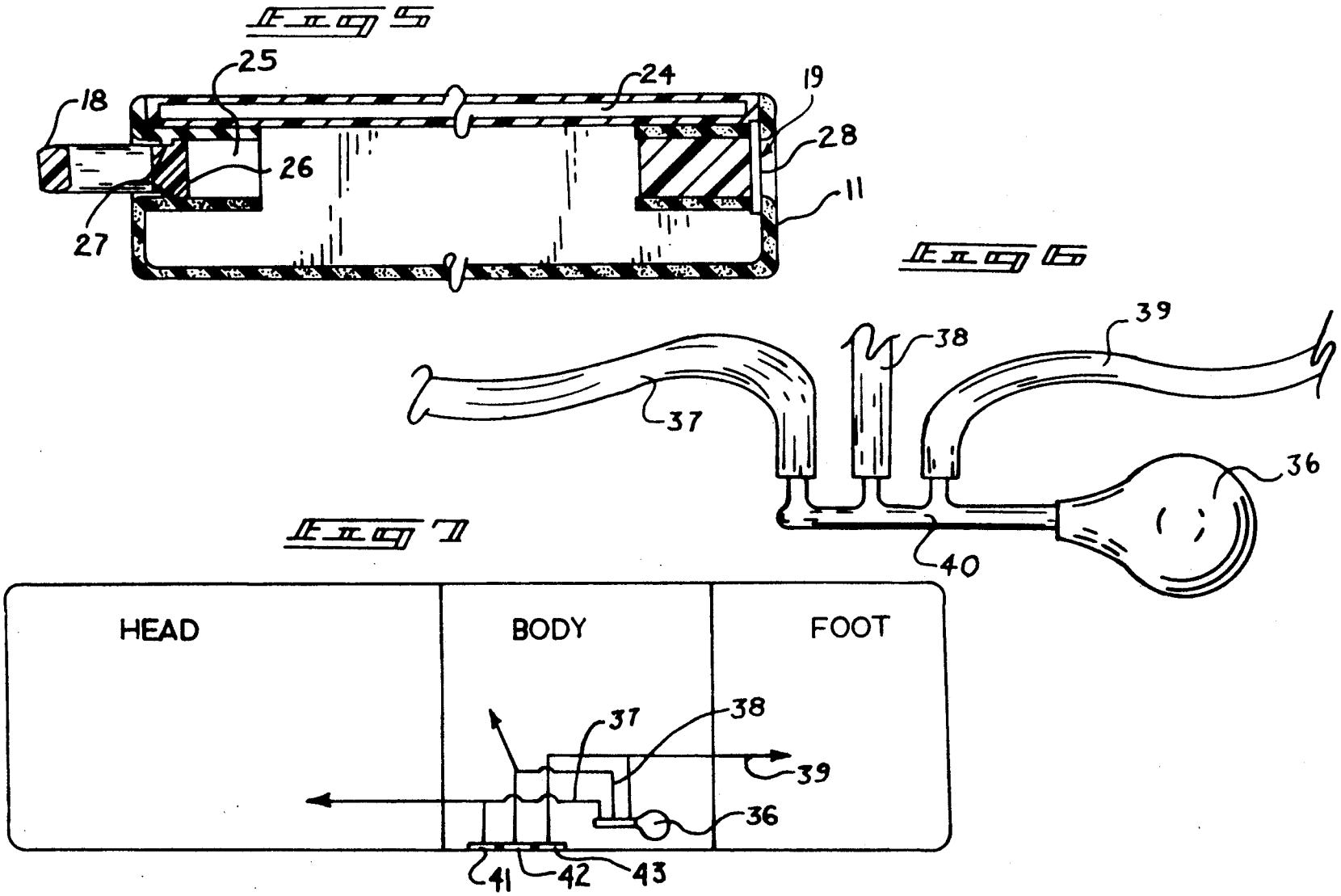
FIG. 5 is an orthographic cross-sectional illustration of one of the body support housings of the instant invention.
FIG. 6 is an orthographic side view of an inflation mechanism utilized by the instant invention.
FIG. 7 is a diagrammatic illustration of the inflation mechanism in association with the various body support portions of the invention.
Figures 8, 9, 10, 11:
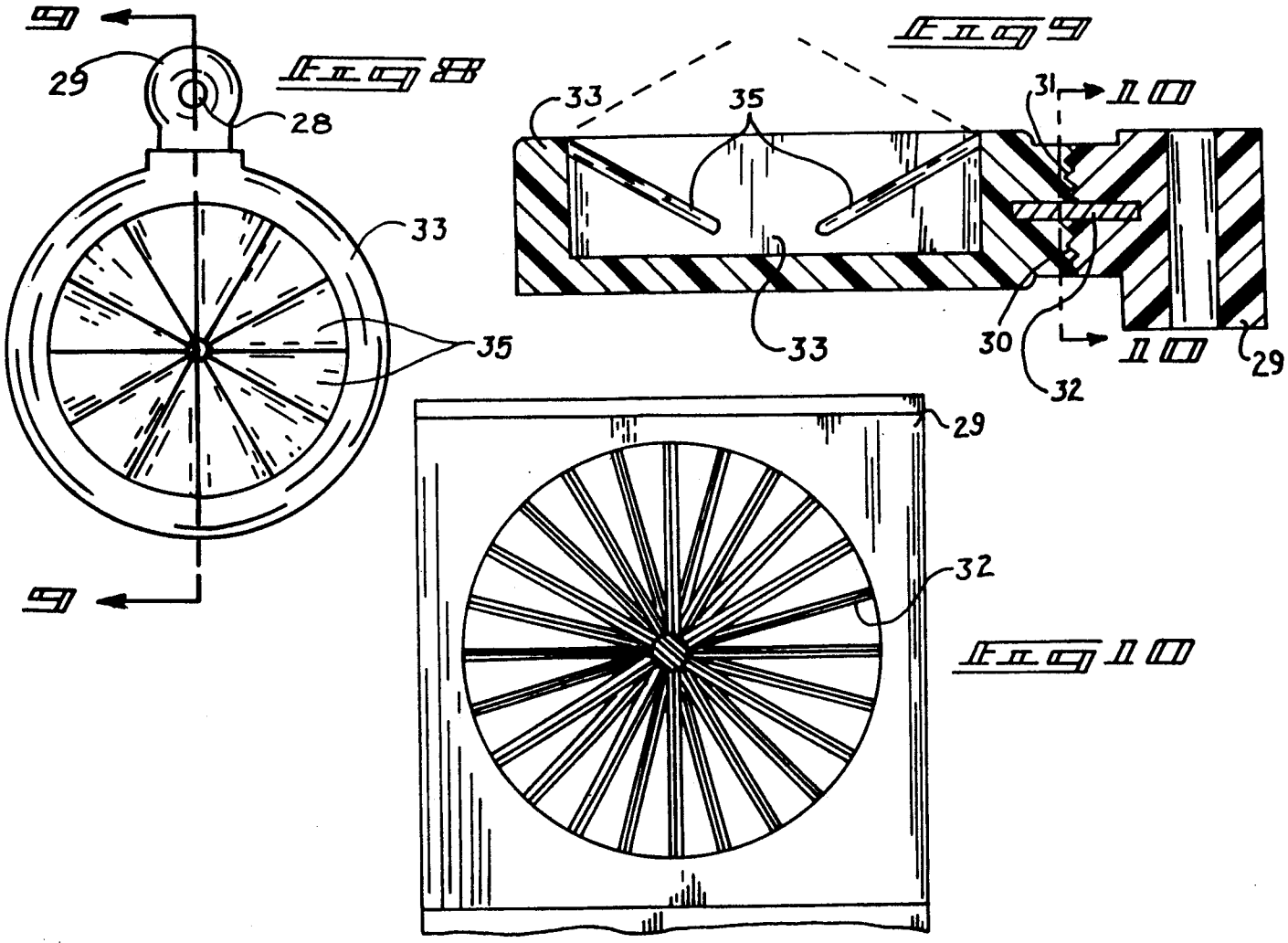
FIG. 8 is an orthographic top view of the cup holder member utilized by the instant invention.
FIG. 9 is an orthographic view, taken along the lines 9—9 of FIG. 8 in the direction indicated by the arrows.
FIG. 10 is an orthographic view, taken along the lines 10—10 of FIG. 8 in the direction indicated by the arrows.

It should be noted that each support housing of the torso support housing 11, the first leg support housing 12, and the second leg support housing 13 each include a pneumatic chamber 24, as exemplified in FIG. 5, directed coextensively about each top surface of each housing. Each pneumatic chamber 24 is selectively inflatable utilizing an inflation bulb 36 (see FIGS. 2 and 6), with the inflation bulb 36 in operative association with a manifold member 40 that directs selective inflation of the support housing 11, the first leg support housing 12, and the second leg support housing 13 through a respective first, second, and third pneumatic conduit 37, 38, and 39. Each pneumatic conduit 37, 38, and 39 is selectively released through a respective first, second, and third release valve 41, 42, and 43 mounted through a side wall of the second leg support housing 13.

The handle 18 is mounted within a handle cavity 25, with a handle plate 26 mounted at an inner terminal end of a handle 18, wherein spaced parallel flanges 27 mounted to upper and lower sides of the cavity 25 capture the handle plate 26 within the cavity 25.

The drink support assembly 19 is pivotally mounted within an associated cavity about a cup holder pivot pin 28 that is directed through a pivot pin boss 29. The pivot pin boss 29 includes a first tooth circular surface 30 oriented orthogonally relative to the pivot pin 28 cooperative with a second tooth circular surface 31 mounted on a cup holder support 33. The cup holder support 33 includes a cavity 34 therewithin. A pivot axle 32 rotatably secures the first and second tooth circular surfaces 31 together to permit rotation of the support 33 relative to the pivot pin boss 29.

It should be noted that the length of the torso support housing is defined by a first length, whereas the first leg support housing is defined by a second length, the second leg support housing is defined by a third length, wherein a total of the second length and third length is equal to the first length of the torso support housing to provide an interfolded configuration as illustrated in FIG. 4. Further, with the first, second, and third axles 15, 16, and 17 arranged parallel relative to one another, the organization is arranged for a folded configuration, as illustrated in FIG. 4.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foldable body support apparatus, comprising in combination, a torso support housing, and a first leg support housing pivotally mounted to the torso support housing about a second axle, and the first leg support housing pivotally mounted to a second leg support housing about a third pivot axle, and a support leg pivotally mounted to the torso support housing remote from the first leg support housing about a first axle, wherein the torso support housing, the first leg support housing, and the second support housing each include a planar top surface and a planar bottom surface, and the torso support housing is defined by a first length, the first leg support housing is defined by a second length, and the second leg support housing defined by a third length, wherein the first length is equal to the second length plus the third length, and the torso support housing including a support leg receiving cavity formed through the torso support housing bottom surface, wherein the support leg receiving cavity defined by a predetermined configuration, and the support leg is defined by an equal predetermined configuration, wherein the support leg receiving cavity complementarily receives the support leg therewithin, and the first axle, the second axle, and the third axle are arranged parallel relative to one another and, including a retractable handle mounted through a first side of the torso support housing and a drink support assembly mounted through a second side of the torso support housing opposed to the first side, and wherein the retractable handle is mounted within a handle cavity, and the handle includes a handle plate mounted to an inner terminal end of the handle slidable within the handle cavity, and wherein the handle cavity includes a plurality of spaced parallel flanges positioned exteriorly of the handle plate to capture the handle plate within the handle cavity.

2. An apparatus as set forth in claim 1 including a hook and loop strap member mounted medially adjacent a forward terminal end of the second leg support housing and cooperative with a hook and loop fastener patch mounted medially adjacent an inner end of the support leg adjacent the first axle.

3. An apparatus as set forth in claim 2 wherein the torso support housing, the first leg support housing, and the second leg support housing each include a pneumatic chamber coextensively mounted through each top surface of each housing, and an inflation bulb mounted through the first leg support housing, including a first pneumatic conduit in operative association with the torso support housing, a second pneumatic conduit in operative association through the first leg support housing, and a third pneumatic conduit in operative association through the second leg support housing to effect selective inflation of each pneumatic chamber of each housing, and each conduit of the first, second, and third pneumatic conduits includes a respective first, second, and third release valve to effect selective pressure relief of each pneumatic chamber.

4. An apparatus as set forth in claim 3 wherein the drink support assembly includes a pivot pin boss, and a pivot pin directed through the pivot pin boss to secure the pivot pin boss within the drink support assembly within the second side of the torso support housing, and the pivot pin boss including a first tooth circular surface orthogonally oriented relative to the pivot pin boss, and a cup holder support, with the cup holder support including a second tooth circular surface in cooperative association with the first tooth circular surface to effect selective rotation of the cup holder support relative to the pivot pin boss, with a pivot axle coaxially directed through the first tooth circular surface and the second tooth circular surface to effect selective rotation of the first tooth circular surface relative to the second tooth circular surface, and wherein the cup holder support includes a support cavity mounted therewithin, and the support cavity includes a plurality of flanges overlying the support cavity to restrain a cup member mounted therewithin.

* * * * *